United States Patent [19]

Stair

[11] 4,392,479

[45] Jul. 12, 1983

[54] FUEL LOADER

[76] Inventor: Eugene V. Stair, Rte. 1, Caddo, Okla. 74729

[21] Appl. No.: 266,123

[22] Filed: May 21, 1981

[51] Int. Cl.[3] ..... F23J 1/00

[52] U.S. Cl. ..... 126/242; 110/116; 414/182

[58] Field of Search ..... 126/68, 73, 74, 107, 126/124, 242; 110/101 R, 101 A, 101 C, 293; 414/180, 182, 199, 160

[56] References Cited

U.S. PATENT DOCUMENTS

| | | | |
|---|---|---|---|
| 3,426 | 2/1844 | Durant | 126/68 |
| 56,979 | 8/1866 | Hall et al. . | |
| 62,935 | 3/1867 | Byrd . | |
| 254,375 | 2/1882 | Reeves . | |
| 418,159 | 12/1889 | Broomell | 110/116 |
| 639,729 | 12/1899 | Holtsclaw | 126/242 |
| 641,064 | 1/1900 | Anderson | 126/242 |
| 879,622 | 2/1908 | Galvin | 126/242 |
| 904,756 | 11/1908 | Clement | 126/242 |
| 946,469 | 1/1910 | Sharp | 126/242 |
| 1,196,407 | 8/1916 | Twaddle | 414/182 |
| 1,435,070 | 11/1922 | Kent . | |
| 1,535,637 | 4/1925 | Venetz | 126/242 |
| 1,705,548 | 3/1929 | Sydow | 110/116 |
| 2,162,579 | 6/1939 | Hogan | 126/242 |
| 4,154,211 | 5/1979 | Choate . | |

*Primary Examiner*—Daniel J. O'Connor
*Attorney, Agent, or Firm*—Dunlap & Codding

[57] ABSTRACT

An improved fuel loader for loading fuel through a firebox opening in a stove and into a stove firebox, the fuel loader having a base sized and adapted for supporting the fuel to be loaded into the stove firebox and a handle assembly connected to the base which is manually grippable by an individual for maneuvering a portion of the base through the firebox opening and into the firebox for loading the fuel supported thereon into the firebox.

5 Claims, 3 Drawing Figures

FUEL LOADER

BACKGROUND OF THE INVENTION

Field of the Invention

The present invention relates generally to devices for loading fuel and, more particularly, but not by way of limitation, to a fuel loader for manually loading fuel into a stove firebox.

BRIEF DESCRIPTION OF THE PREFERRED EMBODIMENT

Figure 1:
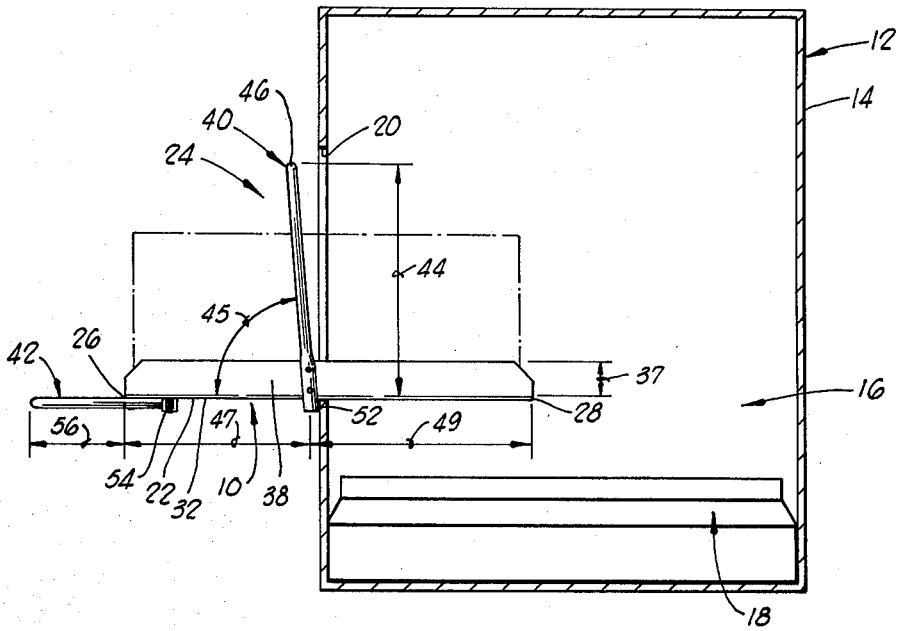
FIG. 1 is a diagrammatic view of a cross section of a portion of a typical wood burning stove showing a side elevational view of the fuel loader of the present invention.

Referring to the drawings in general, and to FIG. 1 in particular, shown therein and designated by the general reference numeral 10 is a fuel loader which is constructed in accordance with the present invention. The fuel loader 10 is adapted for loading fuel into a stove, a diagrammatic cross sectional view of a portion of a stove being shown in FIG. 1 and designated therein via the general reference numeral 12.

The stove 12 includes a frame 14 which constitutes the general supporting structure of the stove 12. A firebox 16 is disposed within the frame 14, the frame 14 generally surrounding the firebox 16 and the firebox 16 generally being that portion of the stove 12 where the fuel is burned. A grate 18 is supported within the firebox 16, the grate 18 being generally supported by the frame 14 and the grate 18 being sized and adapted for supporting the fuel within the firebox 16. A firebox opening 20 is formed through the frame 14 and the firebox opening is sized and positioned to provide access to the firebox 16 and the grate 18 disposed therein.

The fuel loader 10 is constructed to support the fuel to be loaded into the firebox 16 and to facilitate the loading of such fuel in a more convenient and safer manner. A portion of the fuel loader 10 is disposable through the firebox opening 20 to a position wherein a portion of the fuel loader 10 is disposed generally in the firebox 16 and above the grate 18, as shown in FIG. 1. In this position, the fuel loader 10 is maneuvered to unload the fuel disposed thereon onto the grate 18 in the firebox opening 20.

Figure 2:
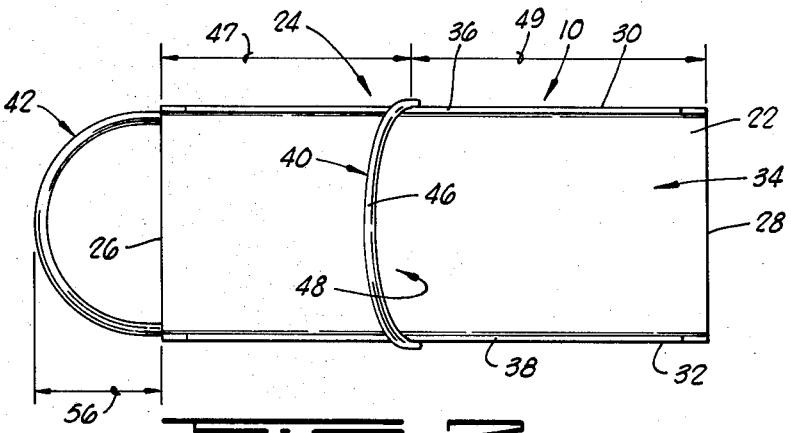
FIG. 2 is a top elevational view of the fuel loader of the present invention.
Figure 3:
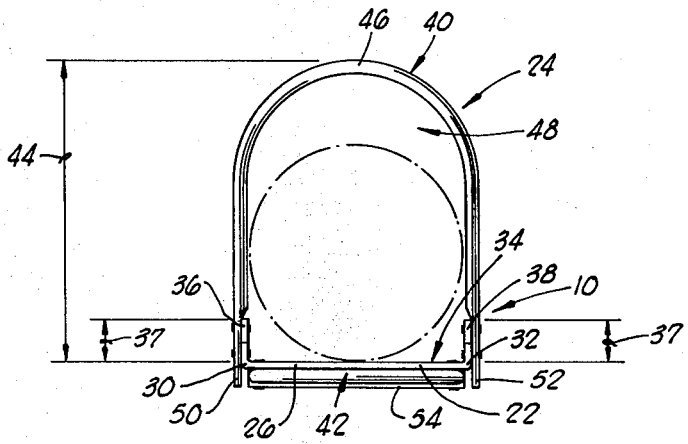
FIG. 3 is an end elevational view of the fuel loader of the present invention.

As shown in FIGS. 1, 2, and 3, the fuel loader 10 generally includes a base 22 and a handle assembly 24. The base 22 is sized and adapted to support the fuel to be loaded into the firebox 16 of the stove 12 and a portion of the base 22 is disposable through the firebox 16 during the operation of the fuel loader 10. The handle assembly 24 is constructed and adapted to be gripped by an individual for manually maneuvering a portion of the base 22 through the firebox opening 20 and into the firebox 16 for loading the fuel supported on the base 22 onto the grate 18 in the firebox 16.

The base 22 has a first end 26, a second end 28, a first side 30 and a second side 32. The base 22 forms a supporting surface 34 which is sized and adapted for supporting the fuel to be loaded into the firebox 16 of the stove 12, the supporting surface 34 extending generally between the first and second ends 26, 28 and generally between the first and second sides 30, 32.

A first side panel 36 is connected to the first side 30 of the base 22, the first side panel 36 extending a distance 37 generally perpendicularly upwardly from the base 22 and generally along the first side 30 of the base 22 between the first and second ends 26, 28. A second side panel 38 is connected to the second side 32 of the base 22, the second side panel 38 extending the distance 37 generally perpendicularly upwardly from the base 22 and generally along the second side 32 between its first and second ends 26, 28. The first and second side panels 36, 38 are sized, positioned and adapted to cooperate in holding the fuel on the supporting surface 34 during the operation of the fuel loader 10.

The handle assembly 24 generally includes an upper handle 40 and an end handle 42. One end of the upper handle 40 is securedly connected to the first side 30 of the base 22 or, more particularly, to the first side panel 36. The opposite end of the upper handle 40 is securedly connected to the second side 32 or, more particularly, to the second side panel 38. The upper handle 40 extends a distance 44 generally above the supporting surface 34, the upper handle 40 extending upwardly from the first and second sides 30, 32 of the base 22 and extending generally over the supporting surface 34 of the base 22 generally between the first and second sides 30, 32 of the base 22. The upper handle 40 extends from the base 22 at an angle 45. The portion of the upper handle 40 which extends over the supporting surface 34 is formed on an arc, the arc portion being designated via the general reference numeral 46 in the drawings. The upper handle 40 cooperates with the supporting surface 34 to form an opening 48 and the upper handle 40 cooperates with the first and the second side panels 36, 38 and the supporting surface 34 to hold the fuel supported on the supporting surface 34 during the operation of the fuel loader 10. The upper handle 40 and, particularly, the arc portion 46, is sized, positioned, and adapted to be grippable by an individual during the operation of the fuel loader 10.

The upper handle assembly 48 cooperates with the supporting surface 34 to form or provide an opening 48. The opening 48 is sized so that the fuel to be loaded into the stove 12 can be supported on the supporting surface 34 with a portion of such fuel being diposed within or extending through the opening 48.

The upper handle 40 is spaced a distance 47 from the first end 26 and spaced a distance 49 from the second end 28 of the base 22. In one embodiment of the invention, the distance 47 is slightly less than the distance 49. The distances 47, 49 are sized so that the fuel is balanced as it is supported on the supporting surface 34, during the operation of the fuel loader 10.

A portion of the upper handle 40, generally near the first side 30, extends a distance downwardly from the base 22 and forms a first stop 50. A portion of the upper handle 40, generally near the second side 32 extends a distance downwardly from the base 22 and forms a second stop 52. The first and the second stop 50, 52 are each spaced a distance 47 from the first end 26 and spaced a distance 49 from the second end 28 of the base 22.

A bar 54 is connected to the surface of the base 22, generally opposite the supporting surface 34. The bar 54 extends generally between the opposite first and second sides 30, 32 of the base 22 and is disposed generally near the first end 26, the bar 54 being spaced a distance generally from the first end 26 of the base 22.

One end of the end handle 42 is connected to the base 22, generally near the first end 26 and generally near the first side 30, the end of the end handle 42 more particularly being connected to the bar 54. The end handle 42 extends a distance 56 arcuately from the first end 30 of the base 22 and the opposite end of the end handle 42 is connected to the base 22, generally near the first end 26 and generally near the second side 32, the opposite end of the end handle 42 more particularly being connected to the bar 54. The end handle 42 is constructed, positioned and adapted to be grippable by an individual during the operation of the fuel loader 10. It should be noted that, in one embodiment, the opposite ends of the end handle 42 can be connected to the side panels 36 and 38, respectively, thereby eliminating the necessity of the bar 54.

Although the fuel loader 10 of the present invention is suitable for loading various forms of fuel, the operation will be described herein with respect to fuel in the form of wood logs (shown in FIG. 1) and a wood burning stove 12. The wood log or logs (the fuel), as the case may be depending on the size of the logs involved and the desire of the user, are loaded onto the supporting surface 34 of the fuel loader 10, the logs (fuel) extending generally between the first and second ends 26, 28 of the base 22 and through the opening 48 formed of the upper handle 40.

After the logs (fuel) have been positioned on the supporting surface 34, an individual grips the arc portion 46 of the upper handle 40 with one hand and, with the opposite hand, the individual grips the end handle 42. In this gripping position, the individual easily can lift the fuel loader 10 with the logs (fuel) supported thereon. The gripping of the end handle 42 operates to maintain the fuel loader 10 level while carrying the logs (fuel) with the fuel loader 10.

The second end 28 portion of the base 22 is disposed through the firebox opening 20 of the stove 12 to a position wherein the first and the second stops 50, 52 engage a portion of the frame 14, generally near the firebox opening 20, as shown in FIG. 1. In this position, the second end 28 portion of the base 22 extends into the firebox 16 and is disposed generally over a portion of the grate 18. The upper handle 40 extends at the angle 45 from the base 22 so the upper handle 40 extends from the base 22 generally away from the frame 14 of the stove 12 in the loading position wherein the first and the second stops 50, 52 engage the frame 14, as shown in FIG. 1. The individual gripping on the end handle 42 can easily hold the fuel holder 10 in the position shown in FIG. 1 wherein the fuel holder 10 is balanced on the frame 14 of the stove 12.

While holding the end handle 42 down with one hand to balance the fuel loader 10 and the logs (fuel) supported thereon on the frame 14 of the stove 12, the individual pushes on the end of the log with the opposite hand in a direction to push the log completely into the firebox 16. The end handle 42 then is moved by the individual in a slow, upwardly direction until the log or logs and the inner end of the fuel loader 10 comes to rest on the fuel-hot coals or the grate previously inside the stove. The end handle 42 then is lifted up and pulled in a direction out from the firebox 16 while the log slides from the supporting surface 34 and onto the grate 18 or fuel previously in the stove.

The length of the base 22, generally between the opposite first and second ends 26, 28 is sized to represent substantially the maximum length of the fuel or log which can be loaded into the stove 12. In this manner, the fuel loader 10 also functions as a gauge for the wood (fuel) so one knows the wood (fuel) will fit into the stove 12 before it is carried to the stove 12. The opening 48 also can be sized to provide a gauging function.

The fuel loader 10 permits relatively large pieces of wood to be loaded onto the grate 18 in the firebox 16 in a relatively simple manner and in a manner requiring relatively little effort, as compared to simple hand loading. Further, using the fuel loader 10, it is not necessary for the individual to extend the individual's hands and arms into the firebox 16, thereby providing a safer means for loading fuel (logs) onto the grate 18.

Changes may be made in the construction and the operation of the various elements and assemblies described herein without departing from the spirit and the scope of the invention as defined in the following claims.

What is claimed is:

1. A fuel loader adapted for loading fuel into a stove having a frame with a firebox disposed in the frame, a grate being supported in the firebox adapted to support fuel within the firebox and a firebox opening being provided through the frame providing access to the firebox and the grate disposed therein, the fuel loader comprising:

a base having a first end, a second end, a first side and a second side, the base having a supporting surface sized and adapted for supporting the fuel to be loaded into the stove firebox and a portion of the base being disposable through the firebox opening and into the firebox; and a handle assembly connected to the base, the handle assembly being grippable by an individual for manually maneuvering a portion of the base near the second end of the base through the firebox opening and into the firebox for loading the fuel supported thereon into the firebox; comprising:

an end handle connected to the base, one end of the end handle being connected to the base generally near the first side of the base and the opposite end of the end handle being connected to the base generally near the second side of the base, the end handle extending a distance generally from the first end of the base; and an upper handle, one end of the upper handle being connected to the base generally near the first side of the base and the opposite end of the upper handle being connected to the base generally near the second side of the base, the upper handle extending a distance generally above the supporting surface of the base and a portion of the upper handle extending generally over the supporting surface of the base generally between the first and the second sides of the base, the upper handle being connected to the base at a position spaced a distance from the first end of the base and spaced a distance from the second end of the base to facilitate the balancing of the fuel loader with the fuel supported generally on the supporting surface of the base; and stop means connected to the base and extending a distance therefrom, the stop means being positioned for engaging a portion of the frame of the stove to position the fuel loader in a loading position wherein a portion of the base with the fuel supported thereon extends into the firebox and generally above the grate.

2. The fuel loader of claim 1 defined further to include:

a first side panel connected to the first side of the base and extending a distance generally upwardly therefrom, the first side panel extending generally along the first side and generally between the first and the second ends of the base; and a second side panel connected to the second side of the base and extending a distance generally upwardly therefrom, the second panel extending generally along the second side and generally between the first and the second ends of the base, the first and the second side panels cooperating with the supporting surface of the base to retain the fuel to be loaded into the stove in a position supported on the supporting surface.

3. The fuel loader of claim 1 wherein the upper handle is defined further to include portions extending a distance from the base and forming the stop means.

4. The fuel loader of claim 1 wherein the upper handle is defined further as extending upwardly from the base at an angle.

5. The fuel loader of claim 1 wherein the length of the base, generally between the opposite first and second ends of the base is sized to represent substantially the maximum length of the fuel which is loadable into the stove, the fuel loader being capable of providing a gauge for the fuel.

* * * * *